United States Patent [19]

Mayala et al.

[11] 3,949,467

[45] Apr. 13, 1976

[54] SOLDERLESS ELECTRICAL CONNECTOR ELEMENT APPLICATION METHOD AND APPARATUS

[75] Inventors: Arne H. Mayala, Stillwater; Thomas J. Antolak, St. Paul, both of Minn.

[73] Assignee: Minnesota Mining and Manufacturing Company, St. Paul, Minn.

[22] Filed: June 26, 1975

[21] Appl. No.: 590,600

Related U.S. Application Data

[60] Division of Ser. No. 494,773, Aug. 5, 1974, abandoned, which is a continuation of Ser. No. 329,108, Feb. 2, 1973.

[52] U.S. Cl. ..... 29/628; 29/203 J; 29/203 HC; 29/203 MW

[51] Int. Cl.[2] ..... H01R 43/00

[58] Field of Search 29/628, 203 J, 203 H, 203 HC, 29/203 MW, 203 HT, 203 DT; 339/97, 98, 99, 276

[56] References Cited

UNITED STATES PATENTS

| | | | |
|---|---|---|---|
| 3,202,957 | 8/1965 | Leach | 339/98 |
| 3,320,354 | 5/1967 | Marley et al. | 174/84 |
| 3,393,438 | 7/1968 | Marley et al. | 29/203 HT |
| 3,456,325 | 7/1969 | Langlois et al. | 29/203 DT |
| 3,517,804 | 6/1970 | Faulkner | 206/56 |
| 3,605,072 | 9/1971 | Driscoll | 339/98 |
| 3,878,603 | 4/1975 | Jensen et al. | 29/628 X |

*Primary Examiner*—Victor A. DiPalma
*Attorney, Agent, or Firm*—Alexander, Sell, Steldt & DeLaHunt

[57] ABSTRACT

Slotted resilient wire-connectors or contact elements are removably disposed in an elongate array and are rapidly forcibly applied seriatim to electrical conductors supported across slots in receptor bases on electrical apparatus to make rapid solderless spring compression reserve contact with the electrical conductors.

4 Claims, 29 Drawing Figures

SOLDERLESS ELECTRICAL CONNECTOR ELEMENT APPLICATION METHOD AND APPARATUS

CROSS-REFERENCE TO RELATED APPLICATION

This application is a division of our copending application Ser. No. 494,773, now abandoned, filed Aug. 5, 1974 which is a continuation of our application Ser. No. 329,108 filed Feb. 2, 1973.

FIELD OF THE INVENTION

This invention relates to the application of spring compression reserve connectors to make solderless electrical contact with insulated wires.

BACKGROUND OF THE INVENTION

Wire-connectors for making spring compression reserve solderless electrical connection with insulated wires have been described in U.S. Pat. No. 3,012,219 and in numerous subsequent patents. The connectors comprise a thin deeply slotted resilient connector plate or contact element fitting closely within a deep groove opening across a wire-supporting surface in an insulating base member and with the slot of the connector plate in line with the wire-supporting surface. Both single plate and multiple plate contact elements, with slots for one, two or more wires or other conductors are described. The plates may be permanently attached to an insulating cap or, as shown for example in U.S. Pat. No. 3,388,370, may be slidably supported in a slotted insulating body member. A number of connector plates may be retained in separate slots in a body member for simultaneously making contact with wires of a multiple conductor flat cable, e.g. as in the U.S. Pat. No. 3,434,093. The contact legs of the connector plate may be internally perforated, as shown in the U.S. Pat. No. 3,605,072, to provide stress relief and other advantages. Wire cut-off capability is demonstrated in U.S. Pat. No. 3,202,957.

The present invention likewise makes use of thin deeply slotted resilient connector plates or contact elements guided into slots opening across wire-supporting surfaces in a receptacle body for making solderless spring compression reserve electrical contact with insulated wires and other conductors, but employs novel means and method for supporting and applying the elements, resulting in a number of advantages which will become apparent as the description proceeds.

The invention provides a novel and rapid method and system for making connection to and between electrically conductive elements including insulated wires, and which is particularly applicable to repetitive high speed commercial assembly operations.

THE DRAWING

Figure 1:
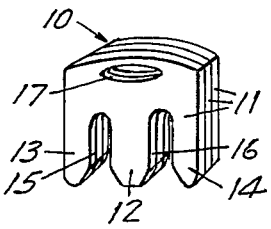
FIG. 1 is a view in perspective of a portion of an assemblage of one form of spring compression reserve contact elements.
Figure 2:
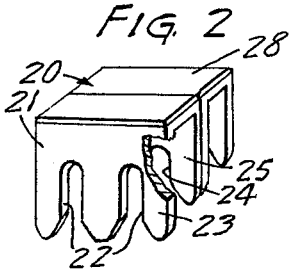
FIG. 2 is a view in perspective of a similar assembly of elements of a different form.
Figure 4:
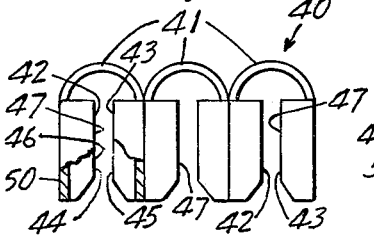
FIG. 4 is a partial side elevation, partly in section, showing an assemblage of another form of contact element.
Figure 6:
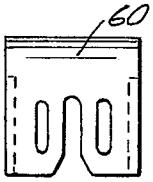
Figure 21:
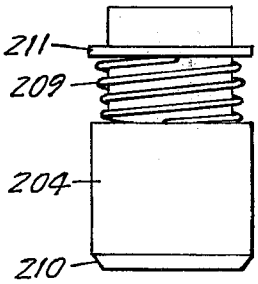
Figure 20:
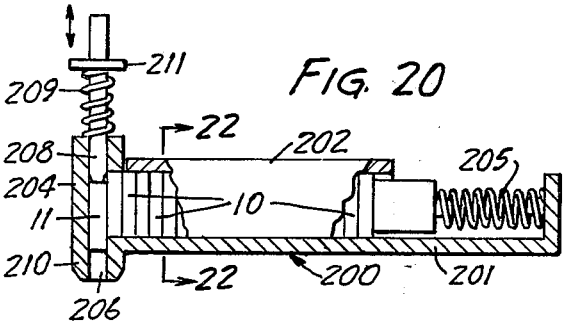
Figure 22:
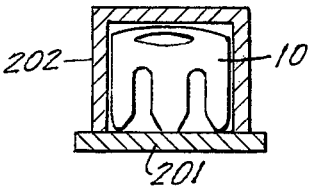
Figure 23:
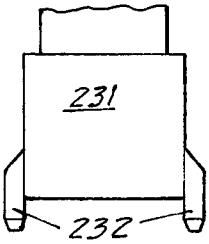
Figure 12:
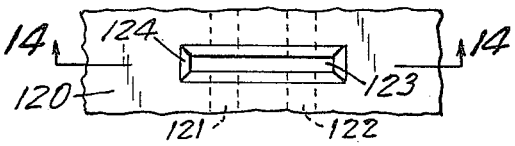
Figure 13:
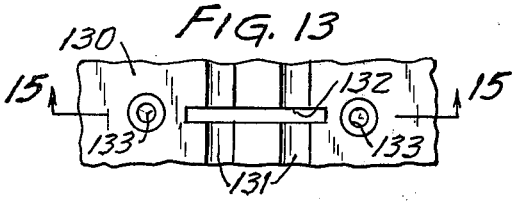
Figure 14:
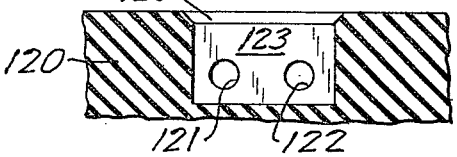
Figure 15:
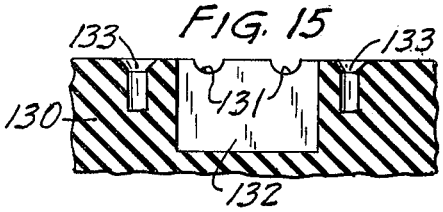
Figure 16:
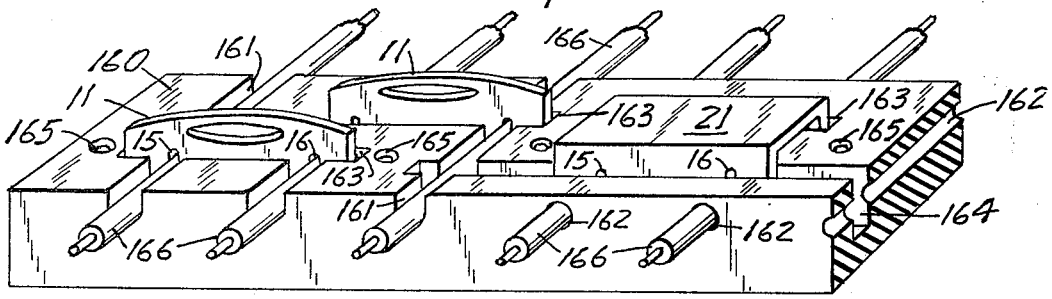
Figure 17:
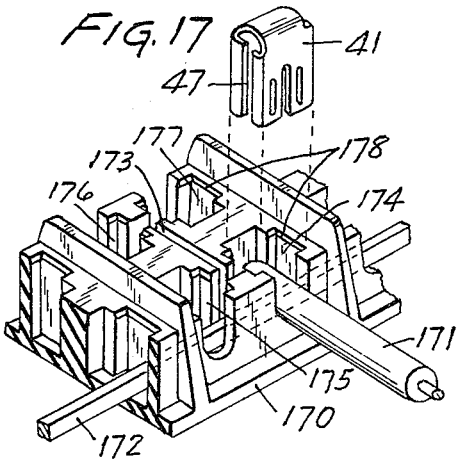
Figure 18:
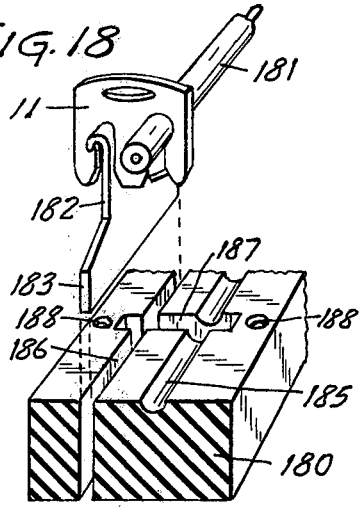
Figure 19:
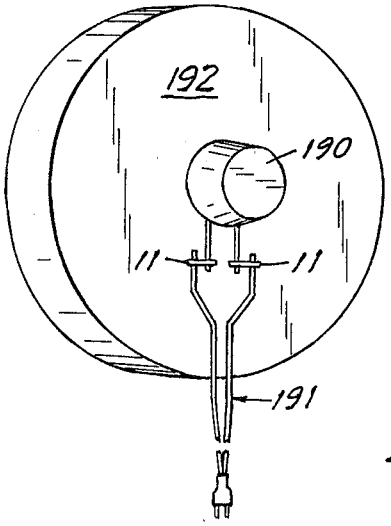

FIGS. 12 and 13 are fragmentary top plan views showing a slotted receptor with different forms of indexing means, and FIGS. 14 and 15 are sectional elevations thereof taken approximately at lines 14—14 and 15—15 respectively;

FIG. 16 is a partial view in perspective of a receptacle or wire support member with contact elements of FIGS. 1 and 2 shown attached to wires supported thereby;

FIG. 17 is an exploded view in perspective of another form of wire support member employing the contact elements of the assemblage of FIGS. 4 and 6;

FIG. 18 is a partially exploded view in perspective showing a contact element of FIG. 1 connecting an insulated wire and a contact plate member, the support member being withdrawn and partially broken away to show detail;

FIG. 19 is a schematic representation of an electrical device incorporating a receptacle and contact elements in making connection between internal and external circuitry;

FIG. 20 is a schematic representation in side elevation and partly in section of a mechanical device or tool useful in positioning and installing the contact elements of FIG. 1, FIG. 21 is an end elevation of a portion of the device of FIG. 20, FIG. 22 is a sectional elevation taken approximately at line 22—22 of FIG. 20, FIG. 23 is a partial end elevation of a tool having an alternative form of indexing means, and FIGS. 24—29 illustrate additional forms of contact element assemblages.

The assemblage 10 of FIG. 1 comprises a series of doubly slotted elements each consisting of a conductive contact plate 11 of thin spring brass or other resilient metal slotted from one edge to form a central prong 12 and two side prongs 13, 14 defining two flared open-ended wire-receiving slots 15, 16 and optionally perforated near the opposite edge to provide a central elongate perforation 17 useful in subsequent removal of the installed element where desired.

The several contact plates 11 are removably retained in face-to-back tandem relationship in the assemblage 10, for example by means of a frangible light coating of lacquer or other analogous bonding agent, not shown, applied between the contacting surfaces or along one or more edges of the assembly, and permitting removal of terminal plates by sliding pressure or impact, such as may be applied with a mechanical device operating on the principle of an office stapler.

Figure 3:
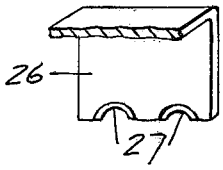
FIG. 3 is a view in perspective and partly in section of a portion of an alternative form of an element of FIG. 2.

Another form of contact element is illustrated in FIG. 2, showing an assemblage 20 of elements 21 again in face-to-back relationship. Each element consists of an elongate thin plate doubly slotted from each end and doubly transversely folded in generally U-shaped cross-section to form two interconnected opposing contact plates with their corresponding wire-receiving slots in mutual alignment. Slots 22 in front plate 23 are preferably identical in width and depth with slots 24 in rear plate 25 but may be either larger or smaller. In the modification illustrated in FIG. 3, the rearward leg 26 is provided with cutting edges 27 in alignment with the slots 22 in the forward leg 23 and these contact elements are useful in simultaneously making contact with wires and severing the excess wire-ends. In both cases the elements may be held in face-to-back relationship by a coating of frangible lacquer or adhesive tape applied over the outer surface of the portion of the strip connecting the two legs of the U. When applied along the flat continuous surface of the assemblage as indicated by the indented top coating shown in FIG. 2, and with the lacquer or other insulative coating material formulated to remain permanently bonded to the metal surface, the bonding agent serves the further purpose of a protective insulative coating 28 over the exposed top of the element.

Figure 5:
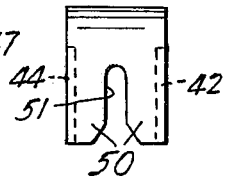
FIGS. 5–8 are end elevations showing various alternative face plate structures for the contact elements of FIG. 4.
Figure 7:
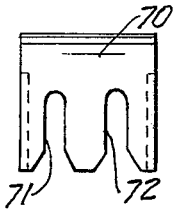
Figure 8:
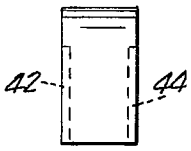

FIG. 4 illustrates an elongate assemblage 40 of another form of contact element 41 formed by bending and folding a wide strip of resilient metal plate into generally U-shaped cross-section and with the side margins again folded to place the external edges 42, 43 and 44, 45 closely adjacent to and opposing each other, whereby to define narrow opposing slot-like openings 46, 47 in the sides of the connector, into which a conductor may be driven through the flared lower open ends illustrated in the Figure. The front and rear faces of the elements 41 may remain blank as shown in FIG. 8, but will preferably be internally singly slotted to form a narrow wire-receiving slot 51 as shown for front face 50 in FIG. 5, thus, in conjunction with the slotted side plates formed by the folded margins, making possible the interconnection of two conductors disposed crosswise of each other. The front face 60 of FIG. 6 is additionally perforated to impart a measure of stress relief; and in FIG. 7 the front face 70 is shown as having two parallel slots 71, 72 thus further increasing the contact capability.

Figure 9:
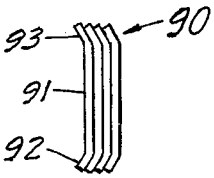
FIG. 9 is a partial top plan view of an assemblage of another form of contact element shown in front elevation in FIG. 10.
Figure 10:
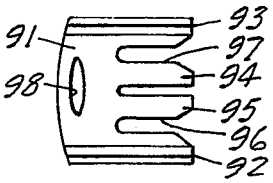

The contact elements 91 of assemblage 90 of FIG. 9 and as further illustrated in FIG. 10 differ from element 11 of FIG. 1 in having side edges 92, 93 angled to provide reinforcement and rigidity. Spring compression reserve is obtained by deeply narrowly slotting the central leg to form two separate half-legs 94, 95 which are resiliently forced toward each other on forceful introduction of wires into the wire-receiving slots 96, 97. The angled outer edges 92, 93 may therefore be rigidly held in the closely fitting receptacle or insulating base.

As in the element 11 of FIG. 1, a perforation 98 at the edge opposite the slotted edge of the element 91 of FIGS. 9 and 10 provides handle means permitting the element to be withdrawn from wire-contacting position, e.g., by prying with a screwdriver. A different form of handle means is employed in the contact elements 111 comprising the assemblage 110 of FIG. 11. As shown in the illustration, a projecting lug 112 having cross grooves or striations 113 extends from the edge opposite the wire-accepting edge and may be grasped with pliers in removing the element from wire-contacting position. Similar projections may alternatively or additionally serve as contact lugs for connecting with additional circuitry if desired.

Figure 11:
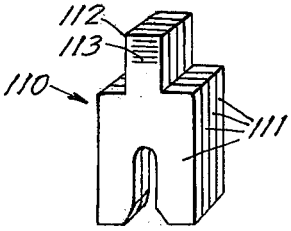
FIG. 11 is a view in perspective of a partial assemblage of another form of contact element.

FIGS. 12–15 illustrate two different indexing means for ensuring proper positioning of a terminal contact element prior to forcing it into the conductor-supporting slotted base or receptacle and onto the conductors. The receptacle 120 of FIGS. 12 and 14 is provided with channels 121, 122 for entry of wire-ends to be connected, narrow deep slot 123 crossing the channels and into which a contact element 11 of FIG. 1 is to be inserted, and a depression 124 defined by beveled edges outlining an elongate truncated pyramid at the mouth of the slot 123. The receptacle 130 of FIGS. 13 and 15 is provided with grooves 131 for supporting a pair of wire-ends, a narrow deep slot 132 crossing the grooves for receiving the contact element, and a plurality of open-mouthed depressions 133 here shown as one near each end and in line with the slot 132. Contact elements having extended removal lugs 112 as described in connection with FIG. 11 are useful with this form of receptacle, as well as the elements 11 of FIG. 1.

The receptacle or base member 160 of FIG. 16 is provided with wire-supporting open channels 161, tubular wire-supporting openings 162, slots 163 and extended slot 164, and with index apertures 165. As illustrated, it supports wires 166, two single-plate contact elements 11, and one double-plate contact element 21. The support member may be of any desired size and shape and may be provided with any desired combination of grooves, openings, slots and apertures.

FIG. 17 illustrates a receptacle 170 in which a contact element 41 of FIG. 4, having the face-plate structure shown in FIG. 6 makes contact between a wire-conductor 171 and another conductor 172 underlying said wire-conductor at right angles thereto. The conductor 172 is supported on a narrow ridge, not shown, extending upwardly from the bottom of the cavity 174 between the slots for the side plates of the element 41, and itself serves to support the central span of the wire 171 between the slots for the face and back plates of the element. The conductor 172 is here illustrated as a metal rod but alternatively may be a sheet-metal form with a vertical central portion supported within the central slot 173 and with horizontal arms extending into each of the four element-receiving compartments 174–177 for entry into the slots 46, 47 of the contact elements. The structure thus permits a connection to be made between four wire-ends inserted into the four compartments, as well as numerous variations. The several compartments are provided with outwardly beveled or sloping upper wall margins 178 serving as indexing means for ensuring correct placement of the applicator prior to insertion of the contact elements.

In FIG. 18 the contact member 11 of FIG. 1 is shown connecting an insulated wire 181 and a contact tab 182, the latter extending from a plate 183. The plate 183 and wire 181 are shown removed from the supporting base 180 which has a wire-supporting surface groove 185, plate-retaining slot 186, element-receiving transverse slot 187, and indexing apertures 188.

As an illustrative example further indicating the utility of the invention, FIG. 19 represents an electrical device in the form of a clock having a motor 190 to the terminals of which has been connected an attachment cord and plug assembly 191 by means of contacts 11, the frame 192 of the clock being provided with element-receiving slots and indexing depressions not here shown but as previously illustrated in connection with FIGS. 12 and 14. The tops of the elements lie flush with the frame surface.

Contact elements of each of the several forms hereinbefore described and illustrated, and, like those of FIGS. 1 and 2, removably disposed in elongate assemblage, are particularly applicable for use in hand-operated or automatic applicator devices. One exemplary form of applicator is schematically illustrated in FIG. 20. The applicator 200 consists essentially of a frame 201 supporting an elongate open-sided and open-ended cartridge 202 carrying a contact element assemblalge 10. The assemblage is biased toward an end stop 204 by a spring and plunger assembly 205. An opening 206 in the bottom of the end stop permits a terminal contact element 11 to be separated from the assemblage 10 and expelled from the applicator under force exerted through a ram 208, which is thereafter returned to starting position by the spring 209 acting on the stop 211. The open bottom of the stop 204 is in the form of a hollow truncated pyramid 210 and fits closely within the pyramidal depression 124 of a receptacle as illustrated in FIGS. 12 and 14, thereby ensuring perfect alignment between the element 11 and the slot 123 into which it is to be forced.

An alternative indexing structure is illustrated in FIG. 23 showing an open-bottomed stop 231 fitted with blunt-pointed pins 232 at opposite sides, i.e., adjacent the opposite ends of the narrow opening through which the contact elements are to be ejected by the ram 208, and extending in the direction of movement of the contact element during ejection. The pins are positioned to fit within the depressions 133 of the receptacle 130 of FIGS. 13 and 15.

Force may be applied to the ram 208 in the direction of the downward arrow by any suitable means including hand-operated mechanical linkage, hydraulic cylinder, electric motor, or impact; and various known mechanisms are available for such purposes. The force applied is sufficient to break any bond between the terminal element and the one next in line, and to force the element through the opening 206, into an appropriate slot or cavity in a receptor, and onto the conductor or conductors supported by the receptor, with resilient deformation of the contact element and establishing of a solderless spring compression reserve connection. In some cases, a simple hand-held tool without mechanical linkage, or if desired with spring-assisted impact mechanism, may be used to detach and apply the terminal contact element; but uniformity and speed of application are ordinarily increased using mechanical equipment as above indicated.

It is to be understood that various modifications and combinations of structural species hereinbefore described are to be considered as lying within the ambit of the invention. As an illustrative example, the perforation 17 of the elements of FIG. 1 may serve as handle means in place of the extension 112 of the element of FIG. 11. Where double plate elements 21 of FIG. 2 are to replace the single plate elements 11 of FIG. 1, it will be appreciated that the opening 206 of the applicator tool must be appropriately widened. Again, the impact edge of the ram 208 which contacts the contact element may be shaped to fit the rounded upper edge of single plate elements 11, or the wide flat upper face of double plate elements 21, or the wide rounded upper face of elements 41 of FIG. 4, or the shoulders or other portions of elements 111 of FIG. 11.

Other modifications of means for removably retaining the contact elements in an assemblage are illustrated in FIGS. 24–29, and additional combinations of these and other means are contemplated as coming within the ambit of the invention.

Figure 24:
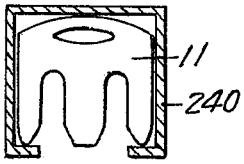

The assemblage of which the foremost member 11 is shown in FIG. 24 is retained within a cartridge or container 240 shown in lateral cross-section. Removable end tabs, not shown, suffice to retain the elements within the cartridge until required. Removal of the tabs then permits the assemblage to be slid from the cartridge 240 directly into the similarly dimensioned cartridge 202 of the applicator 200 of FIG. 20.

Figure 25:
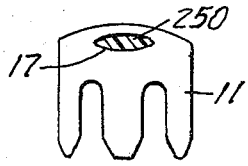
Figure 26:
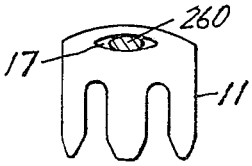
Figure 27:
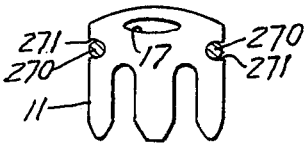

FIG. 25 similarly shows a foremost element 11 of an assemblage of elements, in this case held in face-to-back contact by an elongate frangible plastic rod 250 passing through the perforations 17 along the entire length of the assemblage. In the assemblage of FIG. 26 a flattened metal rod 260, similarly positioned, retains the elements 11 in position but permits them to be slid from the free end of the rod into position for being driven through the outlet aperture 206 of the applicator 200. For such arrangements the applicator end stop 204 is provided with leaf springs at the inner side edges, or with other equivalent retaining means for holding the foremost element above the aperture 206 prior to depression of the ram 208. In FIG. 27, rods 270 fitting within edge openings 271 support the assemblage of elements 11; the rods may be frangible as for the assemblage of FIG. 25, or permanent and recoverable as for FIG. 26.

Figure 28:
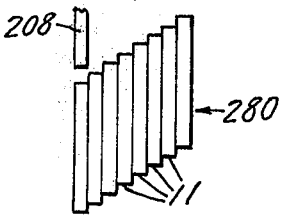

FIG. 28 shows in side elevation an assemblage 280 of elements 11 disposed in stepped association and retained in position either with a frangible bonding medium or other wise, with a ram 208 indicated in position over the foremost element. This configuration, and the appropriate modification of the applicator 200, permits improved clearance between applicator and workpiece, which is an advantage where space is limited. Lateral offsetting of elements is also contemplated.

Figure 29:
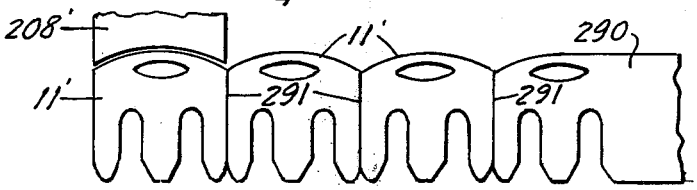

The contact elements may alternatively be disposed in edge-to-edge relationship. As shown in FIG. 29, elements 11' are formed edge-to-edge from a continuous strip 290, the strip at the line of separation 291 being cut to an extent permitting easy removal of the foremost element under impact by the plunger 208' while still holding the remaining elements together. An assemblage may then consist of a small number of elements in each of a plurality of strips of elements, the strips being packed face-to-back and the foremost strip being then displaced along its length and transversely of the pack as the individual elements are removed. Alternatively, a strip of a large number of elements may be coiled on itself and fed into an appropriately modified applicator at the edge rather than the face of the stop 204 for subsequent forceful removal of the foremost element.

It is also contemplated to supply the elements in bulk and then to align them as a continually re-forming assemblage, by well-recognized means such as a revolving and/or reciprocating alignment tray device, just prior to use. The procedure is particularly well adapted for large-scale continuous commercial production operations. Since at least some few of the elements must be in the form of an assemblage adjacent the position at which the foremost element is to be acted upon by the ram, this means of supplying the elements is considered to be the full equivalent of the others herein disclosed.

We claim:

1. A method for rapidly making a series of electrical connections in the assembling of electrical apparatus, comprising the steps of:

providing an electrical apparatus with a conductor support base formed to support an electrical conductor across a contact element receiving slot therein, feeding a plurality of spring compression reserve contact elements appressed together in tandem seriatim to an application position in a contact element applicator, aligning the application position of the applicator with the contact element receiving slot in the conductor support base, rapidly forcing the spring compression reserve contact element at the application position over a conductor and into the contact element receiving slot to form spring compression reserve contact with the conductor, and repeating said steps with additional conductors and contact elements.

2. The method of claim 1 wherein the applicator has an indexing structure and the conductor support base includes cooperating indexing means, and wherein said aligning step comprises bringing together the indexing structure and the indexing means prior to the step of rapidly forcing the contact element.

3. A system for rapidly making a series of electrical connections in the assembling of electrical apparatus, comprising:

an electrical apparatus having a conductor support base formed to support an electrical conductor across a contact element receiving slot therein, a contact element applicator for rapidly forcing a spring compression reserve contact element at an application position therein over a conductor and into said contact element receiving slot to form spring compression reserve contact with the conductor, means for feeding a plurality of spring compression reserve contact elements appressed together in tandem seriatim to said application position in said applicator, and means for aligning said application position in said applicator with said contact element receiving slot in said conductor support base.

4. The system of claim 3 wherein said means for aligning comprises an indexing structure on said applicator and cooperating indexing means on said conductor support base.

* * * * *